US008313010B2

(12) United States Patent
Quinlan et al.

(10) Patent No.: US 8,313,010 B2
(45) Date of Patent: Nov. 20, 2012

(54) BIFURCATED FOAM PUMP ASSEMBLY

(75) Inventors: Robert L. Quinlan, Stow, OH (US); Mark E. Rosenkranz, Medina, OH (US); Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 617 days.

(21) Appl. No.: 12/069,321

(22) Filed: Feb. 8, 2008

(65) Prior Publication Data

US 2009/0200339 A1 Aug. 13, 2009

(51) Int. Cl.
*B67D 5/58* (2006.01)

(52) U.S. Cl. ..... 222/190; 222/401

(58) Field of Classification Search ..... 222/190, 222/401

See application file for complete search history.

(56) References Cited

U.S. PATENT DOCUMENTS

| | | | | |
|---|---|---|---|---|
| 4,880,161 | A * | 11/1989 | Wright | 222/190 |
| 4,957,218 | A * | 9/1990 | Ford, Jr. | 222/190 |
| 5,222,633 | A * | 6/1993 | Blake | 222/190 |
| 5,372,281 | A | 12/1994 | Palmer et al. | |
| 5,411,177 | A * | 5/1995 | Blake, III | 222/190 |
| 5,445,288 | A * | 8/1995 | Banks | 222/190 |
| 5,752,627 | A | 5/1998 | Vandromme et al. | |
| 5,779,104 | A | 7/1998 | Reidel | |
| 5,984,146 | A * | 11/1999 | Kaufman | 222/190 |
| 6,082,586 | A | 7/2000 | Banks | |
| 6,612,468 | B2 | 9/2003 | Pritchett et al. | |
| 2005/0072805 | A1 * | 4/2005 | Matthews | 222/190 |
| 2006/0273114 | A1 | 12/2006 | Ophardt | |
| 2007/0023454 | A1 * | 2/2007 | Ophardt | 222/190 |
| 2008/0083783 | A1 | 4/2008 | Nelson | |
| 2008/0083784 | A1 * | 4/2008 | Foster et al. | 222/190 |
| 2009/0184137 | A1 * | 7/2009 | O'Brien | 222/190 |

FOREIGN PATENT DOCUMENTS

| | | |
|---|---|---|
| CA | 2465055 A1 | 6/2005 |
| WO | 99/49769 | 10/1999 |

OTHER PUBLICATIONS

International Search Report and the Written Opinion from International application No. PCT/US2009/000725, date of mailing May 11, 2009; 12 pages.

European Search Report and Written Opinion dated Sep. 16, 2011, EP Application No. 11172819.2.

European Search Report and Written Opinion dated Oct. 28, 2009, EP Application No. 09152143.5.

Extended European Search Report and Written Opinion for European Application No. 12158630.9, Dated Mar. 26, 2012.

* cited by examiner

*Primary Examiner* — Kevin P Shaver
*Assistant Examiner* — Donnell Long
(74) *Attorney, Agent, or Firm* — Calfee, Halter & Griswold LLP

(57) ABSTRACT

A bifurcated foam pump assembly for use in foam dispensers. A liquid dispensing portion of the foam pump assembly is attached to and disposable/replaceable with a liquid cartridge for the dispenser. The air compressor or air pump portion of the foam pump assembly comprises a portion of the dispenser itself and is attached to the dispenser housing. Upon replacement of a cartridge, the two portions mate and are operative as a foam pump generator. The liquid portion of the foam pump is received within a liquid chamber by gravity, and is subsequently driven from that chamber by air from the air compressor, which drives both the air and liquid through a foam generating member, such as a sponge or mesh. This foam generating member is a part of the liquid portion of the pump, and is replaced with the cartridge.

20 Claims, 1 Drawing Sheet

BIFURCATED FOAM PUMP ASSEMBLY

TECHNICAL FIELD

The invention herein resides in the art of liquid dispensing mechanisms and, more particularly, to those mechanisms that are particularly adapted for dispensing a liquid in the form of a foam. Specifically, the invention relates to the foam pump generator for such dispensers, and particularly one that is bifurcated or separated between the liquid pump portion and the air pump portion. Specifically the invention relates to a foam pump that allows the liquid pump portion to be fixed to and a part of the disposable refill cartridge containing the liquid, and in which the air pump or compressor is a non-disposable portion of the dispenser housing.

BACKGROUND OF THE INVENTION

For many years, it has been known to dispense liquids, such as soaps, sanitizers, cleansers, disinfectants, and the like from a dispenser housing maintaining a removable and replaceable cartridge containing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid, generating the formation of bubbles thereby. Accordingly, the standard liquid pump has given way to a foam generating pump, which necessarily requires means for combining the air and liquid in such a manner as to generate the desired foam. However, foam generating pumps are more expensive than liquid dispensing pumps, necessarily increasing the cost of disposable cartridges that include the pump with each cartridge.

Typically, foam pumps include an air compressor portion and a fluid passing portion—the two requiring communication to ultimately create the foam. The portion required for compressing the air is not given to wear and degradation to the extent of the portion required for passing the liquid and generating the foam from the combination of liquid and air. Accordingly, it has been determined that there is no necessity for replacing the air compressor, but only the liquid pumping and foam generating portion of the pump when replacement of the cartridge is necessary. Accordingly, a bifurcation of the pump has been determined to be possible and desirable.

DISCLOSURE OF THE INVENTION

In light of the foregoing, it is a first aspect of the invention to provide a foam pump generator in which the air compression portion is separate and distinct from the liquid passing and foam generating portion.

Another aspect of the invention is the provision of a bifurcated foam pump generator in which the liquid passing and foam generating portion is disposable and replaceable with a liquid cartridge, while the air generator is substantially fixed to the dispenser housing.

Yet another aspect of the invention is the provision of a bifurcated foam pump generator that is cost effective in implementation and capable of producing high quality foam in operation.

Still a further aspect of the invention is the provision of a bifurcated foam pump generator that is readily constructed from state of the art devices and structures, and that is conducive to implementation with presently existing dispensers.

Still a further aspect of the invention is the provision of a bifurcated foam pump generator, having a portion thereof fixed to a housing of a dispenser and the remaining portion thereof being a part of a replaceable cartridge, and in which the joinder of the parts is easily effected in the field during cartridge replacement.

The foregoing and other aspects of the invention that will become apparent as the detailed description proceeds are achieved by an improvement in a foam dispenser having a dispenser housing and an actuator, and receiving a liquid cartridge, the improvement being a bifurcated foam pump assembly, comprising: an air compressor portion attached to the dispenser housing; and a liquid pump portion connected to the liquid cartridge, said liquid pump portion separably mating with said air compressor portion.

Other aspects of the invention which will become apparent herein are achieved by a liquid container for a foam generating dispenser comprising: a cartridge defining a volume for receiving a liquid; a collar sealingly attached to said cartridge; a cap secured to said collar, said cap and collar defining a liquid cavity; and an outlet nozzle adjacent said foam generating member.

BRIEF DESCRIPTION OF DRAWINGS

For a complete understanding of the various aspects and techniques of the invention, reference should be made to the following detailed description and accompanying drawings wherein.

BEST MODE FOR CARRYING OUT THE INVENTION

Figure 1:
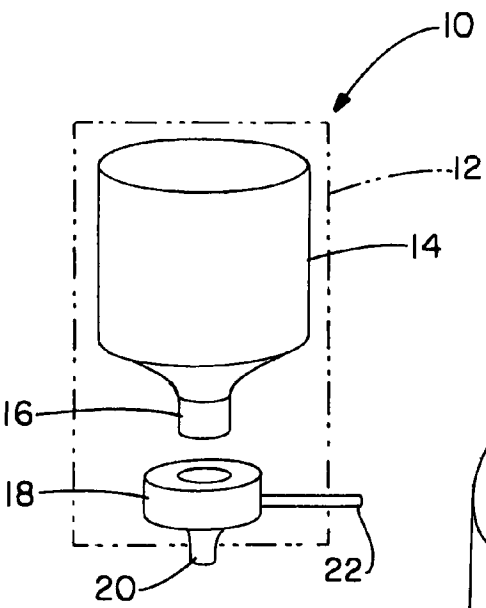
FIG. 1 is an illustrative view of a dispenser and liquid cartridge employing the bifurcated foam pump assembly of the invention.

Referring now to the drawings and more particularly FIG. 1, it can be seen that a foam solution dispenser employing the bifurcated foam pump assembly of the invention is designated generally by the numeral 10. It will be appreciated that the foam solution dispenser may be of any of various types, adapted for dispensing soap, lotion, sanitizers, cleaners or the like in the form of a foam. The dispenser 10 includes a housing 12, typically of molded plastic or the like. The housing 12 defines a cavity which is adapted to receive a bottle or cartridge 14 of a set volume of a liquid of the particular type required for generating the desired foam. The bottle or cartridge 14 is nestingly received by the housing 10 and, as will be readily appreciated by those skilled in the art, is received and contained by supporting brackets, collars and the like within the housing 12.

A liquid pump 16 is connected to and provided as a portion of the disposable refill cartridge or bottle 14. In contradistinction, an air compressor unit 18 is provided as part and parcel of the dispenser housing 12. Alternatively, the air compressor 18 or the liquid pump 16 may include a dispensing nozzle 20, through which the generated foam is dispensed onto the hand of the user, utensil, or otherwise.

A suitable actuator 22 is operatively connected to the air compressor 18 to achieve actuation of the foam generator comprising the combination of the liquid pump 16 and air compressor 18. Those skilled in the art will understand that foam is typically generated from a combination of air and liquid, with the two being forced together, agitated, stirred, forcefully blended, or the like. The actuator 22 may be either manually actuated as in the case of a lever, push bar, or the like, or it may be electronically or optically actuated as in the implementation of touch free dispensers.

It will be appreciated that a concept of the invention, as particularly presented below, is the implementation and utilization of a bifurcated foam pump assembly, in which the liquid pump portion is attached to and made a portion of the disposable and replaceable cartridge 14, containing the liquid ingredient of the foam solution, while the air compressor 18 and associated nozzle 20 are not disposable, but remain a portion of the dispenser housing 12.

Figure 2:
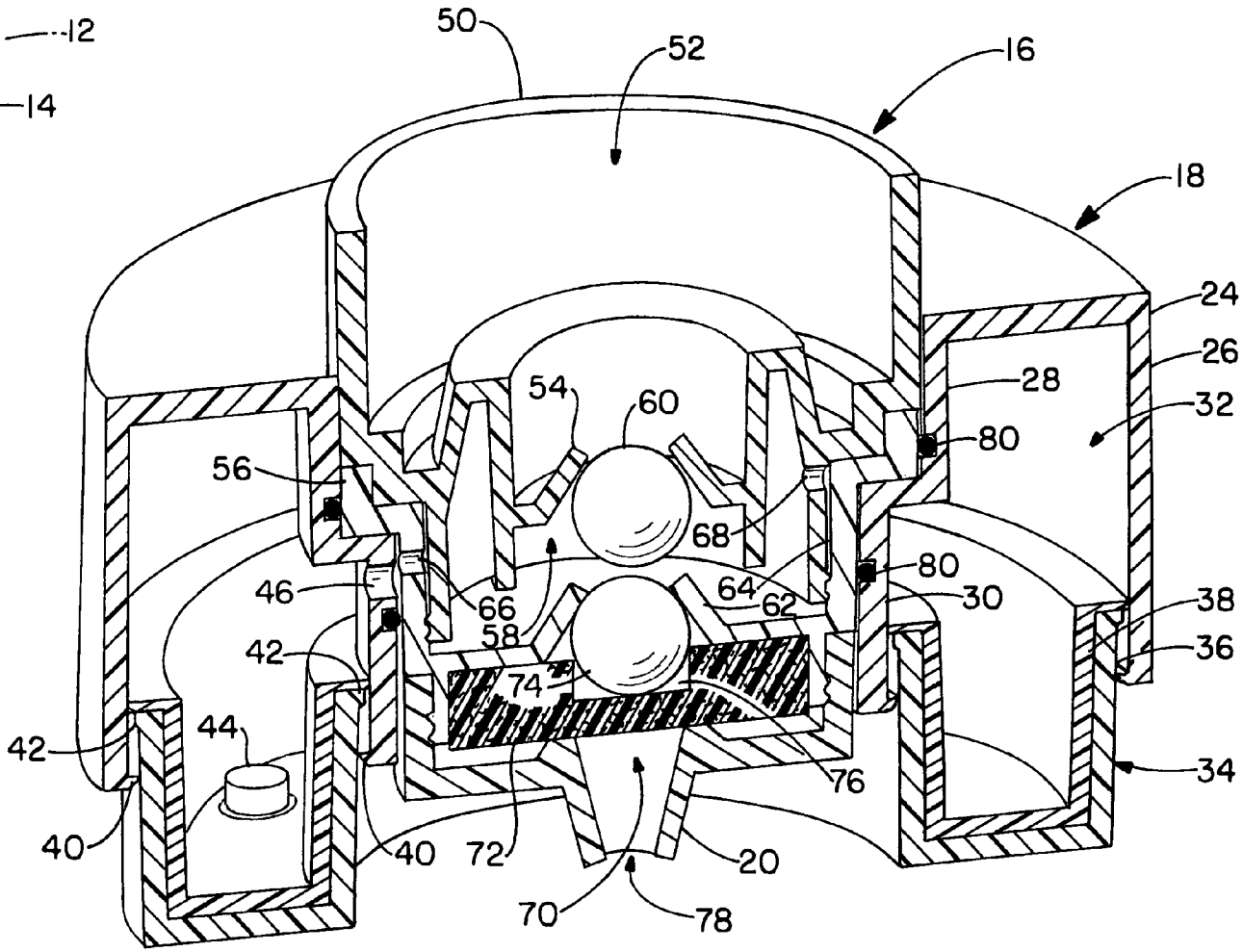
FIG. 2 is a cross sectional view of the bifurcated foam pump assembly of the invention.

Referring now to FIG. 2, an appreciation can be obtained of the bifurcated liquid pump and air compressor assembly, and wherein the two are shown in the operative engagement achieved when the replaceable cartridge 14 with liquid pump 16 attached thereto is matingly received by the air compressor 18 and attached nozzle 20 that are received by and maintained as a portion of the dispenser housing 12. As can be seen in FIG. 2, the air compressor 18 includes an annular collar 24 that is formed from an outer ring 26 and an inner ring established by first and second stepped walls 28, 30. A cavity 32 is defined between the outer ring 26 and the inner ring formed by the interconnected walls 28, 30. A piston 34, consisting of an outer piston sleeve 36 and an inner piston sleeve 38 is received within the cavity 32 of the annular collar 24 and is adapted to operate between the outer ring 26 and one of the stepped inner rings 30. As will be readily appreciated by those skilled in the art, the piston assembly 34 is adapted for reciprocation within the cavity 32. The extending motion of the piston 34 is limited by stops 40, 42 of the annular collar 24 and piston assembly 34, as shown. It will also be appreciated that the inward compressive movement of the piston 34 may be limited in various similar ways, including a limitation on the movement of the actuator 22.

A one way inlet valve 44 is provided in a base portion of the piston 34, to allow air to reenter the air chamber or cavity 32 during operation, as will become apparent herein. It will also be noted that an outlet aperture 46 is provided in the wall 30 of the annular collar 24, to allow communication between the air chamber or cavity 32 and the liquid pump assembly, as will be discussed below.

With continued reference to FIG. 2, it can be seen that the liquid pump 16 includes a collar 50 which is appropriately received by the throat of the disposable cartridge or container 14. The collar defines a cavity 52 and is characterized by an upwardly extending truncated conical valve seat 54 at a bottom portion thereof, as shown. The various ribs and rings illustrated as comprising a portion of the collar 50 are primarily interposed for purposes of strength and rigidity as will be readily appreciated by those skilled in the art. According to a preferred embodiment of the invention, the collar 50, as with the majority of the components of the invention, are molded of an appropriate plastic.

An intermediate cap 56 is attached to and closes an end of the collar 50 to define a liquid dispensing cavity 58 therebetween. A ball valve 60 is received within the cavity 58 and is adapted to sealingly nest with the valve seat 54 during operation, and as will become apparent below. A second valve seat 62, again of a truncated conical nature, is formed as part and parcel of the intermediate cap 56, as shown, and operates as the seat for an outlet valve as will become apparent below.

An annular recess or cavity 64 is provided about the interior wall surface of the cap 56 to provide a ring-like passage between an aperture 66 provided through the wall of the cap 56 and the aperture 68 provided through the wall of the collar 50. Accordingly, there is a passage for communication between the air chamber cavity 32 and the liquid chamber cavity 58 through the apertures 46, 66 and 68, by means of the annular recess or passage 64.

A nozzle 20 is received by and closes the end of the intermediate cap 56, as shown in FIG. 2. A cavity 70 is thus defined between the nozzle 20 and the intermediate cap 56. This outlet chamber or cavity 70 receives an appropriate sponge, screen, mesh assembly, or the like to assist in the generation of foam as a mixture of air from the air chamber or cavity 32 and liquid from the liquid chamber or cavity 58. A ball valve 74 is received by the cavity 70 and is urged by the resilient nature of the sponge, screen, or mesh assembly 72 into nesting sealing engagement with the valve seat 62, at rest. For this purpose, an appropriate recess 76 may be provided in the element 72.

It will be appreciated that the elements comprising the liquid pump 16 are attached to and are a part of the refill cartridge 14 and are received by the annular collar 24 and the remainder of the air chamber or compressor 18 when replacement of the refill cartridge 14 is effected. To that end, appropriate O-ring seals 80 are received within the first and second walls 28, 30 of the inner ring of the collar 24. This allows for and ensures that the passage of liquid from the container 14 only occurs after it is converted to foam for dispensing through the outlet 78 of the nozzle 22.

In operation, the liquid of the cartridge 14 that is required for generating the desired foam passes from the container 14 through the cavity 52 of the collar 50 and, by gravity, passes the seat and ball valve arrangement 54, 60 and flows into the liquid cavity 58 to await a dispensing operation. The seat and ball valve 62, 74 is closed at this time due to the biasing nature of the element 72. When a dispensing operation is initiated as by the actuator 22, the piston 34 moves from engagement between the stops 40, 42 and begins to compress air within the air chamber or cavity 32, forcefully passing that air through the apertures 46, 66, annular recess or passage 64, and through the aperture 68 and into the liquid chamber 58. This compressed air forces the ball valve 60 into sealing engagement with the valve seat 54 and urges the ball valve 74 to disengage from the seat 62 against the biasing of the screen, sponge or mesh 72. A mixture of air and liquid is then forced through the valve assembles 62, 74 and through the foam generating member 72 such that an appropriate foam is emitted through the outlet 78 and onto the hands of the user or a desired tool or implement. At the end of the dispensing cycle, appropriate springs or biasing devices the actuator 22 cause the piston 34 to retract from the cavity 32 until contact is made between the stops 40, 42. During this activity, air is drawn through the one-way valve 44 into the expanding cavity 32 to await the next cycle of operation. Liquid is replenished from the container 14 through the valve assembly 54, 60 by gravity, until the cavity 58 is replenished. The bifurcated foam pump assembly comprising the liquid pump 16 and the air compressor 18 then awaits the next dispensing cycle.

Thus it can be seen that the various aspects of the invention have been achieved by the structure presented and described above. Only the liquid portion of the foam generator is required for replacement upon depletion of the cartridge 14, rather than total replacement of the assembly as with prior art devices. Additionally, the bifurcated foam pump assembly is reliable and durable in use, the element 72 being of sufficient strength and durability to accommodate depletion of the cartridge 14 while generating a high quality foam.

While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A foam dispenser comprising:

an air compressor portion attached to a dispenser housing, the air compressor portion having an air outlet, wherein the air compressor portion does not contact liquid during operation of the dispenser; and a refill unit including a liquid pump portion including a liquid chamber defined in part by a housing, a liquid inlet valve and an outlet valve connected to a liquid cartridge, said liquid pump portion releasably mating with said air compressor portion wherein the refill unit may be replaced when the liquid cartridge is empty without replacing he air compressor portion, which remains attached to the dispenser housing when the refill unit is replaced; and wherein the liquid pump portion includes an air inlet opening that is placed downstream of and in fluid communication with the air outlet of the air compressor portion when the refill unit is properly inserted in the foam dispenser and is not in fluid communication with the air outlet opening of the air compressor portion when the refill unit is not inserted in the foam dispenser.

2. The foam dispenser according to claim 1, further comprising a foam generating member, wherein an actuator drives an air compressor portion, and the air compressor portion effects passage of both air and liquid through the foam generating member.

3. The foam dispenser according to claim 2, wherein said air compressor portion comprises a piston reciprocatingly movable in an air chamber, and wherein said liquid pump portion comprises a liquid chamber filled with liquid by gravity.

4. A foam dispenser comprising:

an air compressor portion attached to a dispenser housing, wherein the air compressor portion does not contact liquid during operation of the foam dispenser; and a liquid pump portion connected to a liquid cartridge, said liquid pump portion separably mating with said air compressor portion;

a foam generating member, and an actuator;

wherein when the actuator drives the air compressor, the air compressor effects passage of both air and liquid through the foam generating member;

wherein said air compressor comprises a piston reciprocatingly movable in an air chamber, and wherein said liquid pump portion comprises a liquid chamber filled with liquid by gravity; and wherein said air chamber communicates with said liquid chamber through an air passage and wherein said liquid chamber includes an inlet valve and an outlet valve, said inlet valve being closed and said outlet valve opened by passage of compressed air from said air chamber to said liquid chamber through said passage.

5. The foam dispenser according to claim 4, wherein said inlet valve is normally open by gravity, and said outlet valve is normally biased closed.

6. The foam dispenser according to claim 5, wherein said foam generating member biases said outlet valve closed.

7. A liquid container for a foam generating dispenser comprising:

a cartridge defining a volume for receiving a liquid;

a collar sealingly attached to said cartridge;

a cap secured to said collar, said cap and collar defining a liquid cavity;

a first aperture located through a wall of the liquid cavity positioned to be in fluid communication with an outlet of an air pump that is secured to the foam generating dispenser when the liquid cartridge is properly placed in a foam generating dispenser and is not in fluid communication with the outlet of an air pump when the liquid cartridge is not in the foam generating dispenser; and an outlet nozzle secured to the cap and adjacent a foam generating member; and wherein the liquid container, liquid cavity and foam generating member are disposable without disposing of the air pump.

8. The liquid container according to claim 7, wherein the liquid cavity is further defined by an inlet valve in communication with the liquid cavity and an outlet valve and during operation air and liquid are mixed in the liquid cavity prior to flowing through the outlet valve.

9. The liquid container according to claim 8, wherein said collar has a second aperture passing through a wall thereof, said first and second apertures being in communication with each other.

10. The liquid container according to claim 9, wherein said inlet valve is movably opened by gravity, and said outlet valve is biased to be normally closed.

11. A liquid container comprising:

a cartridge defining a volume for receiving a liquid;

a collar sealingly attached to said cartridge;

a cap secured to said collar, said cap and collar defining a liquid cavity; and an outlet nozzle adjacent a foam generating member;

wherein said cap has a first aperture passing through a wall thereof, said first aperture being provided and positioned to communicate with an outlet of an air pump of the dispenser;

wherein said collar has a second aperture passing through a wall thereof, said first and second apertures being in communication with each other;

wherein said liquid cavity has an inlet valve and an outlet valve, said inlet valve being movable open by gravity, and said outlet valve being biased to be normally closed; and wherein said foam generating member biases said outlet valve closed.

12. A liquid refill unit for a foam generating dispenser comprising:

a sealed container for holding a foamable liquid;

a liquid chamber connected to the sealed container;

the liquid chamber having an inlet valve communicating with the sealed container and an outlet valve;

the liquid chamber having an air inlet opening for allowing air to mix with the foamable liquid to form an air liquid mixture;

a foam generating member located outside of the liquid chamber for receiving the air liquid mixture to create a foam; and an outlet nozzle for dispensing the foam;

wherein at least one of the liquid chamber and sealed container includes at least one sealing member for creating a seal between the at least one of the liquid chamber and sealed container and an air compressor that is attached to the foam generating dispenser, wherein the air compressor does not contact liquid when liquid is dispensed from the liquid refill, wherein the liquid chamber is releasably engageable with the air compressor so that the sealed container, liquid chamber, and foam generating member may be replaced without replacing the air compressor, which remains secured to the foam generator.

13. The liquid refill unit of claim 12 wherein the air inlet opening is located in a wall of the liquid chamber.

14. The liquid refill unit of claim 12 wherein at least a portion of the liquid chamber is configured to fit within at least a portion of the air compressor.

15. The liquid refill unit of claim 12 wherein the outlet valve is biased in a closed position by the foam generating member.

16. The liquid refill unit of claim 12 wherein when the liquid chamber is empty, the inlet valve allows foamable liquid to enter the liquid chamber until the liquid chamber fills with foamable liquid.

17. The liquid refill unit of claim 12 wherein the volume of the liquid chamber is a constant volume.

18. The liquid refill unit of claim 12 wherein air inlet opening forms a tortuous path from the exterior of the liquid reservoir to the interior of the liquid reservoir.

19. The liquid refill unit of claim 12 wherein the at least one seal comprises an o-ring.

20. The liquid refill unit of claim 12 wherein when the liquid refill unit is inserted into a foam dispenser having an air compressor, the air inlet opening on the outside of the liquid chamber is in fluid communication with an air outlet opening in the air compressor that is attached to foam dispenser.

* * * * *